United States Patent [19]

Witten et al.

[11] Patent Number: 4,711,160

[45] Date of Patent: Dec. 8, 1987

[54] TWO-PIECE FOUNDATION VENTILATOR

[75] Inventors: Alvin E. Witten; Erik H. Witten, both of Gastonia, N.C.

[73] Assignee: Witten Automatic Vent Company, Inc., Gastonia, N.C.

[21] Appl. No.: 48,258

[22] Filed: May 11, 1987

[51] Int. Cl.[4] ..... F24F 7/00

[52] U.S. Cl. ..... 98/29; 98/114

[58] Field of Search ..... 98/1, 29, 32, 37, 114; 236/49 B; 312/111; 52/474, 475

[56] References Cited

U.S. PATENT DOCUMENTS

| | | | |
|---|---|---|---|
| 4,208,010 | 6/1980 | Beam, Jr. et al. | 98/114 X |
| 4,243,175 | 1/1981 | McSwain | 98/32 X |
| 4,274,330 | 6/1981 | Witten et al. | 98/29 X |
| 4,587,892 | 5/1986 | Witten et al. | 98/29 |

*Primary Examiner*—Harold Joyce

*Attorney, Agent, or Firm*—Bell, Seltzer, Park & Gibson

[57] ABSTRACT

The molded plastic rectangular shutter support housing and the mounting cover frame of the two-piece foundation ventilator are provided with connector devices for removably maintaining the shutter support housing and the mounting cover frame in assembled condition and for permitting disassembly of the mounting cover frame and the shutter support housing, if desired. The connecting devices include integrally molded clip members on the mounting cover frame with inwardly extending locking portions positioned in overlying engagement with integrally molded flanges of the shutter support housing to permit the shutter support housing to be removed from the mounting cover frame by sliding the shutter support housing longitudinally in one direction along the mounting cover frame and for assembling the two parts together by longitudinally sliding the shutter support housing in the opposite direction along the mounting cover frame. Locking arms are integrally molded with the shutter support housing and cooperate with the locking clip members to maintain the shutter support housing in assembled condition with the mounting cover frame.

16 Claims, 9 Drawing Figures

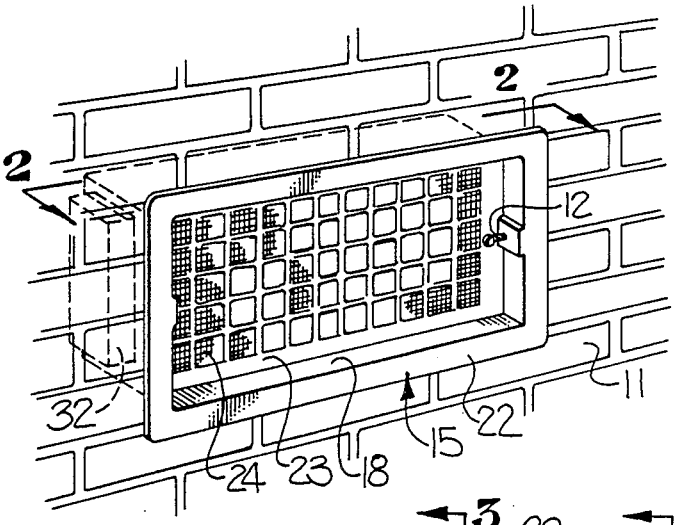
Fig-1
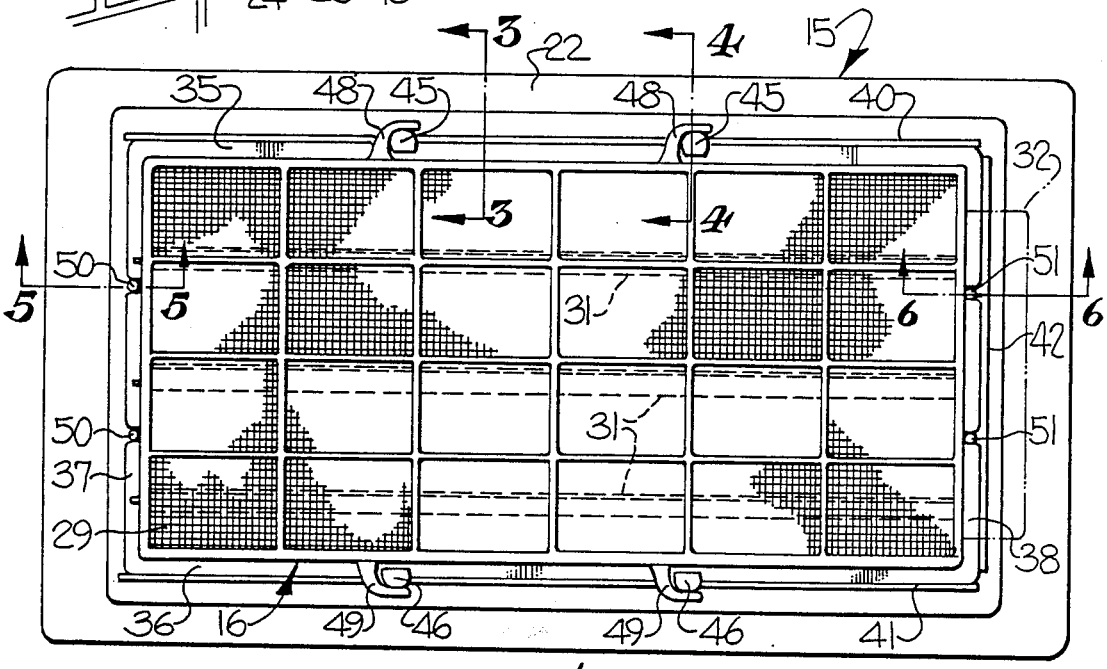
Fig-2
Fig-3
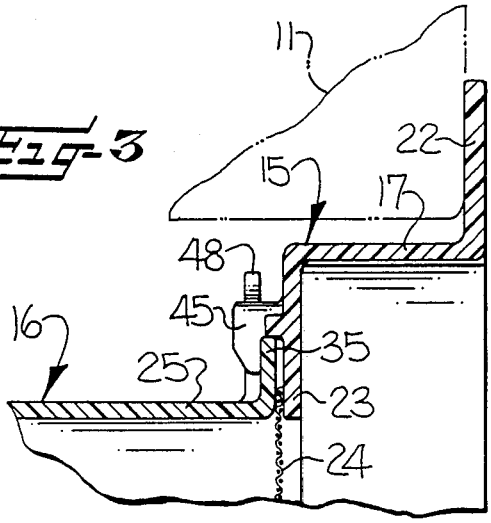
Fig-4
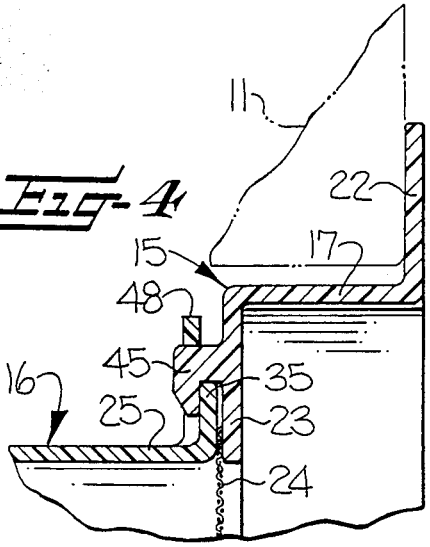

TWO-PIECE FOUNDATION VENTILATOR

FIELD OF THE INVENTION

This invention relates generally to a molded plastic two-piece foundation ventilator including a mounting cover frame and a shutter support housing, and more particularly to improved connector means for easily assembling and disassembling the mounting cover frame and the shutter support housing of the ventilator.

BACKGROUND OF THE INVENTION

For many years it has been the common practice to install ventilators in openings in building walls to provide for the flow of ventilating air through the enclosed crawl space beneath the floor of the building. In recent years, foundation ventilators have been provided with shutters which are thermostatically controlled so that they remain in an open position during warm weather when the temperature is above about 70° F., and the shutters move to a closed position when the outside temperature drops below a predetermined amount, such as 40° F. This type of automatic foundation ventilator is disclosed in U.S. Pat. No. 3,528,606.

U.S. Pat. No. 4,274,330 discloses an automatic ventilator of this general type which includes a rectangular mounting frame that is first mounted in the foundation opening and the shutter support housing is then positioned in and fixed to the mounting frame. U.S. Pat. No. 4,587,892 discloses another automatic ventilator in which the mounting frame and the housing supporting the operating shutters are of molded plastic construction and are preassembled. The automatic ventilator of this patent is mounted in the wall opening in such a manner that the ventilator remains firmly seated in the opening with any expansion or contraction of the ventilator during use.

It has been the common practice to preassemble the molded plastic shutter support housing and the mounting cover frame of the ventilator of U.S. Pat. No. 4,587,892 by integrally molding openings in the outwardly extending flange of the shutter support housing and molding mounting pins on the mounting cover frame to extend into and through the openings in the shutter support housing. The ends of the molded pins extending through the openings are then heated and flattened to fix the shutter support housing to the mounting cover frame. If the ventilator does not operate properly after it has been assembled in this manner, it is very difficult, if not impossible, to separate the shutter support housing and the mounting cover frame to carry out the required repairs or adjustments to the shutter operating mechanism, with the result that the entire automatic ventilator must be discarded.

SUMMARY OF THE INVENTION

With the foregoing in mind, it is an object of the present invention to provide a molded plastic two-piece automatic foundation ventilator which may be easily assembled into condition for mounting in a wall opening and which may be easily disassembled, should it become necessary to make adjustments or repairs to the ventilator after the shutter support housing and the mounting cover frame have been assembled.

In accordance with the present invention, the molded plastic two-piece foundation ventilator includes a rectangular mounting cover frame of predetermined width and height sufficient to be mounted in a rectangular opening in a foundation wall. A rectangular shutter support housing of predetermined width and height of lesser dimensions than the predetermined width and height dimensions of the mounting cover frame is provided for attachment to the rectangular mounting cover frame prior to installation in the rectangular opening in the foundation wall. The shutter support housing and the mounting cover frame are maintained in assembled condition and are easily separated by providing integrally molded flanges extending outwardly from opposite sides of the shutter support housing and by integrally molded upstanding clip members along opposite sides of the mounting cover frame. The upstanding clip members include inwardly extending locking portions which are positioned in overlying engagement with the molded flanges of the shutter support housing to maintain the shutter support housing and the mounting cover frame in assembled condition and to permit easy disassembly of the shutter support housing from the mounting cover frame, if desired.

Locking arms are integrally molded with the flanges of the shutter support housing and extend outwardly therefrom and include locking portions extending at least partially around and outside of the upstanding clip members on the mounting cover frame to prevent accidental inward flexing movement of the flanges so that the locking portions of the clip members are prevented from moving out of overlying engagement with the flanges of the shutter support housing. The locking portions of the locking arms permit sliding movement of the shutter support housing in one direction relative to the mounting cover frame so that the locking arms move out of partially encircling relationship outside of the clip members and permit easy disassembly of the shutter support housing from the mounting cover frame, when desired. Upstanding stabilizing ribs, in the form of guide rails, are integrally molded along opposite sides of the mounting cover frame and are positioned adjacent the opposite sides of the molded flanges of the shutter support housing to aid in sliding the shutter support housing into assembled position on the mounting cover frame. The guide rails also prevent sidewise movement between the shutter support housing and the mounting cover frame.

BRIEF DESCRIPTION OF THE DRAWINGS

Other objects and advantages will appear as the description proceeds when taken in connection with the accompanying drawings, in which FIG. 1 is a fragmentary isometric view showing the present foundation ventilator installed within an opening in a foundation wall or the like;

FIG. 2 is an enlarged rear elevational view of the foundation ventilator, removed from the wall opening;

FIG. 3 is an enlarged vertical sectional view taken substantially along the line 3—3 in FIG. 2;

FIG. 4 is an enlarged vertical sectional view taken substantially along the line 4—4 in FIG. 2;

DESCRIPTION OF THE ILLUSTRATED EMBODIMENT

Figure 5:
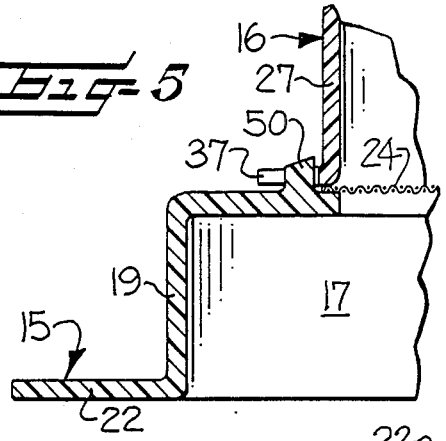
FIG. 5 is an enlarged horizontal sectional view taken substantially along the line 5—5 in FIG. 2.

The present foundation ventilator is illustrated in FIG. 1 in position in a rectangular opening of predetermined width and height in a brick wall 11 in any suitable manner, such as by a mounting screw 12 (FIG. 1). The foundation ventilator is formed of molded plastic two-piece construction and includes a rectangular mounting cover frame, broadly indicated at 15, and a rectangular shutter support housing, broadly indicated at 16. The rectangular mounting cover 15 is of a predetermined width and height which is adapted to be mounted in the rectangular opening of the foundation wall 11 and the rectangular shutter support housing 16 is also of a predetermined width and height of lesser dimensions than the predetermined width and height dimension of the mounting cover frame 15.

Figure 6:
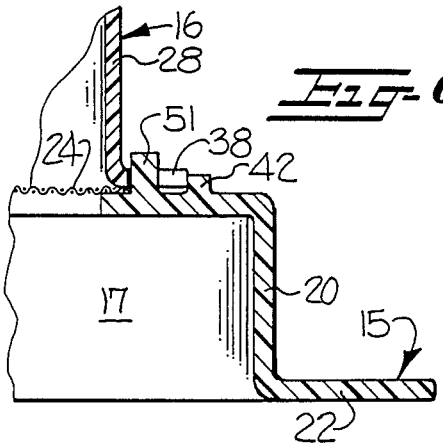
FIG. 6 is an enlarged horizontal section view taken substantially along the line 6—6 in FIG. 2.

The mounting cover frame 15 includes respective upper and lower inwardly extending opposite side walls 17, 18 and spaced opposite end walls 19, 20 (FIGS. 5 and 6). A peripheral flange 22 is integrally molded with the outside of the mounting cover frame and is adapted to extend around and cover the opening in the foundation wall 11 when the foundation ventilator is mounted therein, as illustrated in FIG. 1. A rear wall 23 is integrally molded along opposite sides with the upper and lower side walls 17, 18 and at opposite ends with the end walls 19, 20. The central portion of the rear wall 23 is provided with molded openings adapted to be covered by a screen 24, suitably attached to the rear wall 23 and covering the openings therein.

The rectangular shutter support housing 16 includes respective upper and lower inwardly extending side walls 25, 26 and spaced-apart inwardly extending opposite end walls 27, 28. A rear wall 30 is integrally molded around its peripheral sides and ends with the side walls 25, 26 and the end walls 27, 28 (FIG. 9) and includes integrally molded rectangular openings formed therein. A suitable screen 29 is attached to the inner surface of the rear wall 30 and covers the openings therein. The shutter support housing 16 pivotally supports opposite ends of temperature responsive shutters, indicated in dotted lines at 31 in FIG. 2. The temperature responsive shutters 31 may be of the type shown and described in commonly owned Witten U.S. Pat. No. 4,587,892, which are automatically opened and closed by temperature control means in a control box, indicated in dash-dot lines at 32 in FIGS. 1 and 2, and in solid lines in FIG. 9. The control box 32 is suitably attached to the end wall 28 of the shutter support housing 16.

In accordance with the present invention, means is provided for removably maintaining the shutter support housing 16 and the mounting cover frame 15 in assembled condition and includes integrally molded upper and lower flanges 35, 36 extending outwardly from opposite sides of the respective upper and lower opposite side walls 25, 26 of the shutter support housing 16. Integrally molded opposite end flanges 37, 38 also extend outwardly from the corresponding end walls 27, 28 of the shutter support housing 16.

Upstanding stabilizing ribs, in the form of respective upper and lower guide rails 40, 41, are integrally molded along opposite sides of the rear wall 23 of the mounting cover frame 15. These guide rails 40, 41 are positioned adjacent the opposite outer sides of the molded opposite flanges 35, 36 of the shutter support housing 16 to aid in sliding the shutter support housing 16 into assembled position on the mounting cover frame 15, in a manner to be presently described. An integrally molded stop rail 42 extends upwardly from the rear wall 23 of the mounting cover frame 15 and provides a stop to limit sliding movement of the shutter support housing 16 in one direction along the mounting cover frame 15 when contacted by the outer edge of the outwardly extending flange 38.

Upstanding spaced-apart clip members 45 are integrally molded with the upper guide rail 40 and corresponding clip members 46 are integrally molded with the lower guide rail 41 and extend outwardly therefrom. The clip members 45, 46 each includes inwardly extending locking portions positioned in overlying engagement with the corresponding integrally molded flanges 35, 36 of the shutter support housing 16, as best illustrated in FIGS. 3 and 4, to maintain the shutter support housing 16 and the mounting cover frame 15 in assembled condition and to permit the shutter support housing 16 to be removed from the mounting cover frame 15 by sliding the shutter support housing 16 longitudinally along the mounting cover frame 15 until the corresponding flanges 35, 36 move out of engagement with the inwardly extending locking portions of the corresponding clip members 45, 46, in a manner to be presently described.

Upper locking arms 48 are integrally molded with the upper flange 35 of the shutter support housing 16. Lower locking arms 49 are integrally molded with the lower flange 36 of the shutter support housing 16 (FIG. 2). The locking arms 48, 49 extend outwardly from the upper and lower side flanges 35, 36 and include locking portions extending in parallel spaced relationship to the side flanges 35, 36. The locking portions extend along the outside of the corresponding clip members 45, 46 when the shutter support housing 16 is in assembled condition with the mounting cover frame 15 to prevent inward flexing movement of the upper and lower side walls 17, 18 and the corresponding flanges 35, 36 to thereby maintain the locking portions of the clip members 45, 46 in overlying engagement with the flanges 35, 36 of the shutter support housing 16.

Integrally molded upstanding stop means is associated with the other end of the mounting cover frame 15 and is positioned to engage the shutter support housing 16 and maintain the same in assembled condition. The upstanding stop means includes integrally molded upstanding spaced-apart cam pins 50 (FIGS. 2 and 5), each including an upper inclined cam surface to permit the shutter support housing 16 to ride upwardly and over the upstanding cam pins 50 when the shutter support housing 16 is being moved into assembled condition with the mounting cover frame 15. As illustrated in FIG. 2, the stop pins 50 are positioned in corresponding slots formed in the flange 37 when the shutter support housing 16 is in assembled condition with the mounting cover frame 15. Also, as illustrated in the right-hand end of FIG. 2 and in FIG. 6, upstanding stop pins 51 are integrally molded with the rear wall 23 and adjacent the stop rail 42. These stop pins 51 are positioned in corresponding slots in the flange 38 when the shutter support housing 16 is in assembled condition with the mounting cover frame 15.

Method of Assembly

Figure 7:
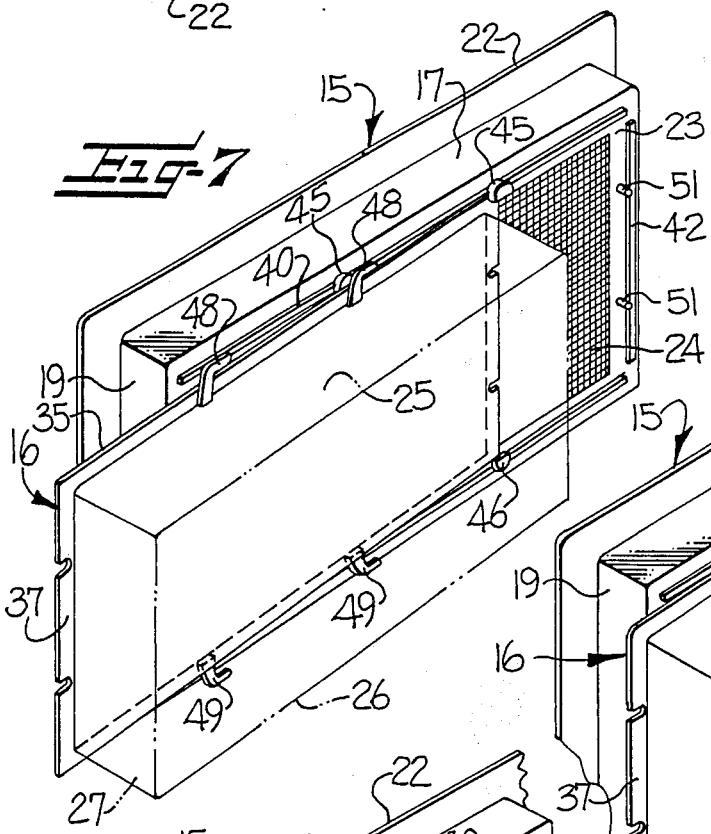
FIG. 7 is an isometric rear view of the ventilator and illustrating the first step in assembling the shutter support housing on the mounting cover frame.
Figure 8:
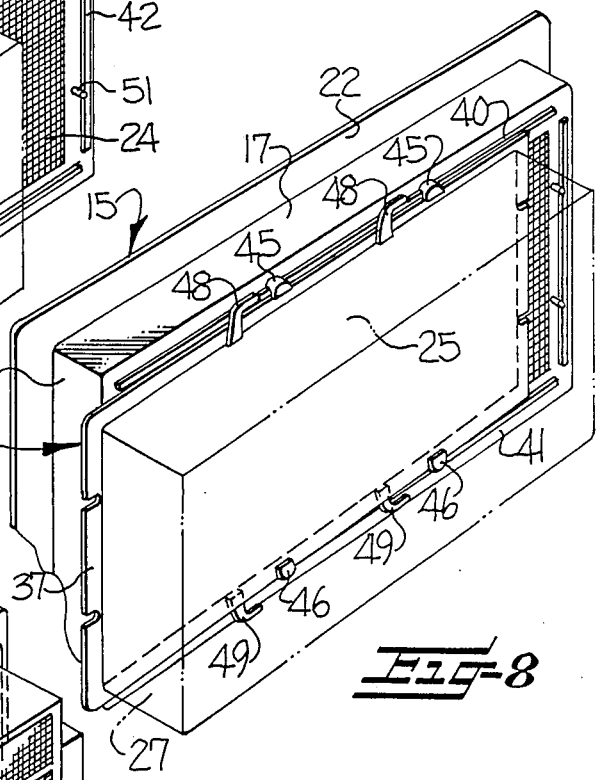
FIG. 8 is a view similar to FIG. 7 and illustrating a further, step in the assembling process.

After the screen 29 has been attached to the inside of the rear wall of the shutter support housing 16 to cover the openings therein, the temperature responsive shutters 31 are installed and the temperature control box 32 is attached to the right-hand end of the shutter support housing 16. Then, the screen 24 is attached to the rear wall 23 of the mounting cover frame 15 to cover the openings therein. The shutter support housing 16 is then aligned with the guide rails 40, 41 extending along opposite sides of the mounting cover frame 15 with the leading edges of the flanges 35, 36 being guided beneath the clip members 45, 46, as illustrated in FIG. 7. Longitudinal sliding movement is imparted to the shutter support housing 16, from left to right in FIG. 7, so that the leading pair of locking arms 48 is moved to a position between the spaced-apart upper and lower clip members 45, 46, as shown in FIG. 8. Inward pressure is then applied against the shutter support housing 16 to force the upper and lower flanges 35, 36 to move inwardly beneath the trailing clip members 45, 46 so that the corresponding locking portions extend in overlying engagement with the flanges 35, 36, as illustrated in FIG. 8.

Figure 9:
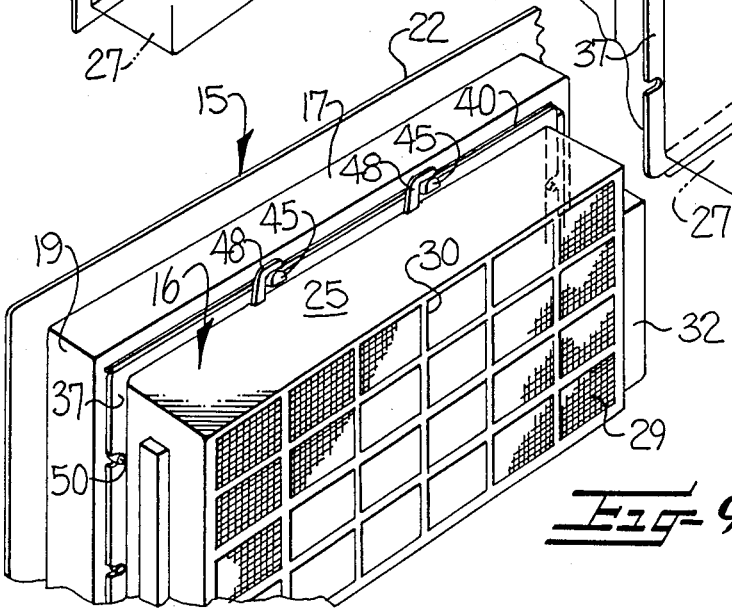
FIG. 9 is a view similar to FIGS. 7 and 8 and illustrating the shutter support housing in fully assembled condition on the mounting cover frame.

Further sliding movement imparted to the shutter support housing 16, from left to right in FIG. 8, moves the locking arms 48, 49 in position adjacent the locking clips 45, 46 with the locking portions of the locking arms 48, 49 extending along the outside of the clip members 45, 46 when the leading edge of the flange 38 engages the stop rib 42. The locking portions of the locking arms 48, 49 thus maintain the locking portions of the clip members 45, 46 in overlying engagement with the flanges 35, 36 of the shutter support housing 16. When the shutter support housing 16 is being moved into assembled condition with the mounting cover frame 15, as shown in FIG. 9, the end wall 27 and the end flange 37 of the shutter support housing 16 will be forced outwardly to move over the inclined upper cam surfaces of the lock pins 50 to prevent sliding movement of the shutter support housing 16 from right to left in FIG. 9 and to thereby maintain the shutter support housing 16 and the mounting cover frame 15 in assembled condition.

Should it be necessary to disassemble the shutter support housing 16 from the mounting cover frame 15, to repair or adjust the temperature responsive shutters 31, or for any other reason, it is only necessary to spring the end wall 27 and the end flange 37 outwardly a sufficient distance to clear the upper end of the lock pins 50 and then sliding movement from right to left may be imparted to the shutter support housing 16, as illustrated in FIG. 8, to free engagement of the locking arms 48, 49 with the corresponding clip members 45, 46. The medial portions of the opposite sides of the shutter support housing 16 may then be flexed inwardly to move the flanges 35, 36 out of engagement with the locking portions of the clip members 45, 46 so that further sliding movement from right to left can be imparted to the shutter support housing 16. Further sliding movement of the shutter support housing 16 from right to left, as illustrated in FIG. 7, will cause the flanges 35, 36 to move out of engagement with the righthand clip members 45, 46 so that the shutter support housing 16 will be completely free of the mounting cover frame 15. After any adjustment is made to the temperature responsive shutters 31, the shutter support housing 16 may be again assembled with the mounting cover frame 15 in the manner previously described.

Thus, the present invention provides means for removably maintaining the shutter support housing 16 and the mounting cover frame 15 in assembled condition and permits easy disassembly of the shutter support housing 16 from the mounting cover frame 15, if desired.

In the drawings and specification there has been set forth the best mode presently contemplated for the practice of the present invention and although specific terms are employed, they are used in a generic and descriptive sense only and not for purposes of limitation, the scope of the invention being defined in the claims.

That which is claimed is:

1. In a molded plastic two-piece foundation ventilator including a rectangular mounting cover frame of predetermined width and height and adapted to be mounted in a rectangular opening in a foundation wall, a peripheral flange integrally molded with the outside of said mounting cover frame and adapted to extend around and cover the opening in the foundation wall, and a rectangular shutter support housing of predetermined width and height of lesser dimensions than said predetermined width and height dimensions of said mounting cover frame, the combination therewith of means for removably maintaining said shutter support housing and said mounting cover frame in assembled condition and comprising (a) integrally molded flanges extending outwardly from opposite sides of said shutter support housing, and (b) upstanding clip members integrally molded along opposite sides of said mounting cover frame, said clip members including inwardly extending locking portions being positioned in overlying engagement with said integrally molded flanges of said shutter support housing to maintain said shutter support housing and said mounting cover frame in assembled condition and to permit said shutter support housing to be removed from said mounting cover frame by sliding said shutter support housing longitudinally along said mounting cover frame until said flanges move out of engagement with said inwardly extending locking portions of said clip members.

2. A foundation ventilator according to claim 1 including a pair of said clip members positioned in spaced-apart relationship along opposite sides of said mounting cover frame.

3. A foundation ventilator according to claim 1 wherein said molded flanges extend along the entire length of opposite sides of said shutter support housing.

4. A foundation ventilator according to claim 1 including a pair of said clip members positioned in spaced-apart relationship along opposite sides of said mounting cover frame, and wherein said molded flanges extend along the entire length of opposite sides of said shutter support housing.

5. A foundation ventilator according to claim 1 including integrally molded guide rails extending along opposite sides of said mounting cover frame for slideably receiving therebetween the outer sides of said flanges of said shutter support housing.

6. A foundation ventilator according to claim 5 wherein said guide rails extend along substantially the entire length of said opposite sides of said mounting cover frame.

7. A foundation ventilator according to claim 5 including an integrally molded rail extending along one end of said mounting cover frame and providing a stop to limit sliding movement of said shutter support housing in one direction along said mounting cover frame.

8. A foundation ventilator according to claim 7 including upstanding stop means integrally molded with the other end of said mounting cover frame and positioned to engage said shutter support housing and maintain said shutter support housing and said mounting cover frame in assembled condition, said upstanding stop means including an upper inclined cam surface to permit said shutter support housing to ride upwardly and over said upstanding stop means when being assembled with said mounting cover frame.

9. In a molded plastic two-piece foundation ventilator including a rectangular mounting cover frame of predetermined width and height and adapted to be mounted in a rectangular opening in a foundation wall, a peripheral flange integrally molded with the outside of said mounting cover frame and adapted to extend around and cover the opening in the foundation wall, and a rectangular shutter support housing of predetermined width and height of lesser dimensions than said predetermined width and height dimensions of said mounting cover frame, the combination therewith of means for removably maintaining said shutter support housing and said mounting cover frame in assembled condition and comprising (a) integrally molded flanges extending outwardly from opposite sides of said shutter support housing, (b) upstanding clip members integrally molded along opposite sides of said mounting cover, said clip members including inwardly extending locking portions being positioned in overlying engagement with said integrally molded flanges of said shutter support housing to maintain said shutter support housing and said mounting cover frame in assembled condition and to permit said shutter support housing to be removed from said mounting cover frame by sliding said shutter support housing longitudinally along said mounting cover frame until said flanges move out of engagement with said inwardly extending locking portions of said clip members, and (c) locking arms integrally molded with said opposite side flanges of said shutter support housing, said locking arms extending outwardly from said opposite side flanges and including locking portions extending in parallel spaced relationship to said opposite side flanges, said locking portions extending along the outside of said clip members when said shutter support housing is in assembled condition with said mounting cover frame to prevent inward movement of said opposite side flanges to thereby maintain said locking portions of said clip members in overlying engagement with said flanges of said shutter support housing.

10. A foundation ventilator according to claim 9 including a pair of said clip members positioned in spaced-apart relationship along opposite sides of said mounting cover frame.

11. A foundation ventilator according to claim 10 wherein said molded flanges extend along the entire length of opposite sides of said shutter support housing.

12. A foundation ventilator according to claim 11 including a pair of said locking arms positioned in spaced-apart relationship along opposite sides of said shutter support housing and adapted to move into and out of locking position relative to said corresponding pairs of said clip members.

13. A foundation ventilator according to claim 12 including integrally molded guide rails extending along opposite sides of said mounting cover frame for slideably receiving therebetween the outer sides of said flanges of said shutter support housing.

14. A foundation ventilator according to claim 13 wherein said guide rails extend along substantially the entire length of said opposite sides of said mounting cover frame.

15. A foundation ventilator according to claim 14 including an integrally molded stop rail extending along one end of said mounting cover frame and providing a stop to limit sliding movement of said shutter support housing in one direction along said mounting cover frame.

16. A foundation ventilator according to claim 15 including integrally molded and upstanding locking pins positioned in spaced-apart relationship adjacent the opposite end of said mounting cover frame, said stop pins including inclined upper cam surfaces for facilitating sliding movement of said shutter support housing into assembled condition with said mounting cover frame and to lock the same in assembled condition.

* * * * *